US006575006B1

(12) United States Patent
Don

(10) Patent No.: US 6,575,006 B1
(45) Date of Patent: Jun. 10, 2003

(54) LOCK

(75) Inventor: Lan-Kun Don, Taiwan (TW)

(73) Assignee: Tung Lung Metal Industry Co., Ltd., Chiayi (TW)

( * ) Notice: Subject to any disclaimer, the term of this patent is extended or adjusted under 35 U.S.C. 154(b) by 0 days.

(21) Appl. No.: 10/136,539

(22) Filed: May 1, 2002

(30) Foreign Application Priority Data

May 14, 2001 (TW) ..... 090207845

(51) Int. Cl.[7] ..... E05B 13/10

(52) U.S. Cl. ..... 70/472; 70/149; 70/223; 70/224

(58) Field of Search ..... 70/472, 149, 218, 70/221–224, 422, 188, 189; 292/DIG. 27

(56) References Cited

U.S. PATENT DOCUMENTS 4,312,201 A * 1/1982 Roos ..... 70/422
4,428,212 A * 1/1984 Best et al. ..... 70/224
5,040,391 A * 8/1991 Lin ..... 70/277
5,074,607 A * 12/1991 Lin ..... 292/359
5,666,833 A * 9/1997 Gao et al. ..... 70/224
5,868,018 A * 2/1999 Kang ..... 70/472
5,987,947 A * 11/1999 Shen ..... 70/467
6,038,894 A * 3/2000 Hu ..... 70/224
6,041,630 A * 3/2000 Shen ..... 70/472
6,101,856 A * 8/2000 Pelletier et al. ..... 70/472
6,105,407 A * 8/2000 Yao ..... 70/472
6,189,351 B1 * 2/2001 Eagan et al. ..... 70/472
6,497,126 B2 * 12/2002 Wang ..... 70/472

FOREIGN PATENT DOCUMENTS

FR 12097 * 7/1910 ..... 292/DIG. 27

* cited by examiner

*Primary Examiner*—Lloyd A. Gall
(74) *Attorney, Agent, or Firm*—Senniger, Powers, Leavitt & Roedel

(57) ABSTRACT

A lock comprising a locking mechanism and a sleeve disk assembly, wherein the locking mechanism comprises: a housing assembly; an outside actuation tube; a key actuation tube; a transmission element; a spring; an outside holding sleeve; a knob rod; when the transmission element is pushed by the knob rod to the first axial position within the key actuation tube, the rotation of the outside actuation tube rotates the outside holding sleeve and the key actuation tube; when the transmission element is at the second axial position within the key actuation tube, the rotation of the outside actuation tube does not rotate the key actuation tube.

8 Claims, 11 Drawing Sheets

LOCK

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention is related to a lock, in particular, the locking device of a door lock.

2. Description of the Related Art

The structure of one kind of conventional door lock is shown in FIG. 1. The door lock generally comprises an inside handle A, which is connected with one end of an inside actuation tube C, and an outside doorknob B, which is connected with one end of an outside actuation tube D. A housing assembly E has a triggering mechanism F therein and the triggering mechanism F can be actuated by the other ends C' and D' of the inside actuation tube C and the outside actuation tube D, respectively, for controlling a latch mounted on the door. The inside actuation tube C has a knob therein, while the outside actuation tube D has a lock assembly at one end therein, which can be controlled by a key to operate a key actuation tube within the outside actuation tube D. The key actuation tube includes an actuation flange G which actuates the triggering mechanism F upon rotation for triggering the latch mounted on the door.

For the conventional door lock structure, the rotation of the outside doorknob B is restrained when the inside knob is pressed down. Thus, in order to open the door lock from outside, a key is used to control the lock assembly and subsequently the key actuation tube for actuating the triggering mechanism F for withdrawing the latch. When the door lock is locked, the rotation of the outside doorknob B is restrained by the interior structure of the lock, resulting easy damage to the interior structure of the lock. Thus, it is desirable to provide a lock in which the outside doorknob B can still be rotated for a predetermined angle after the door lock is locked, so as to prevent damages to the interior structure of the lock by the force exerted on the outside doorknob B.

BRIEF SUMMARY OF THE INVENTION

Accordingly, the primary object of this invention is to provide a locking device for the door lock such that the handle connected with the outside actuation tube can be rotated without triggering the lock assembly when the door lock is locked.

Another object of this invention is to provide a locking device for the door lock which is suitable to be mounted on the doors having a wide range of different thicknesses.

The primary features of the present invention comprises a locking mechanism for actuating a latch and a sleeve disk assembly for mounting the locking mechanism on a door, wherein the locking mechanism comprises: a housing assembly; an outside actuation tube having a first end and a second end, and the first end of the outside actuation tube being mounted in the housing assembly; a key actuation tube being inserted into the outside actuation tube and having a first end and a second end, wherein the first end of the key actuation tube has an actuation flange, and second end of the key actuation tube has an actuation plate, the key actuation tube also having at least one projection extending inwardly; a transmission element provided in the key actuation tube and having at least one groove to be meshed with the at least one projection of the key actuation tube, thereby the transmission element is movable between a first axial position and a second axial position in the key actuation tube and is rotated together with the key actuation tube; a spring with one end thereof resisting against the transmission element and the other end thereof resisting against the actuation plate; an outside holding sleeve connected with the first end of the outside actuation tube so as to be rotated together with the outside actuation tube, the outside holding sleeve further having at least one projection extending inwardly; a knob rod having a first end and a second end, in which the first end of the knob rod is connected with the transmission element and the second end of the knob rod is connected with a push button; when the transmission element is at the first axial position within the key actuation tube, the at least one groove of the transmission element is engaged with the at least one projection of the outside holding sleeve, such that when the outside actuation tube is rotated, the outside holding sleeve and the key actuation tube is subsequently rotated thereby; when the transmission element is at the second axial position within the key actuation tube, the at least one groove of the transmission element is not engaged with the at least one projection of the outside holding sleeve, such that when the outside actuation tube is rotated, the key actuation tube is not rotated.

The structures and characteristics of this invention can be realized by referring to the appended drawings and explanations of the preferred embodiments.

Figure 6:
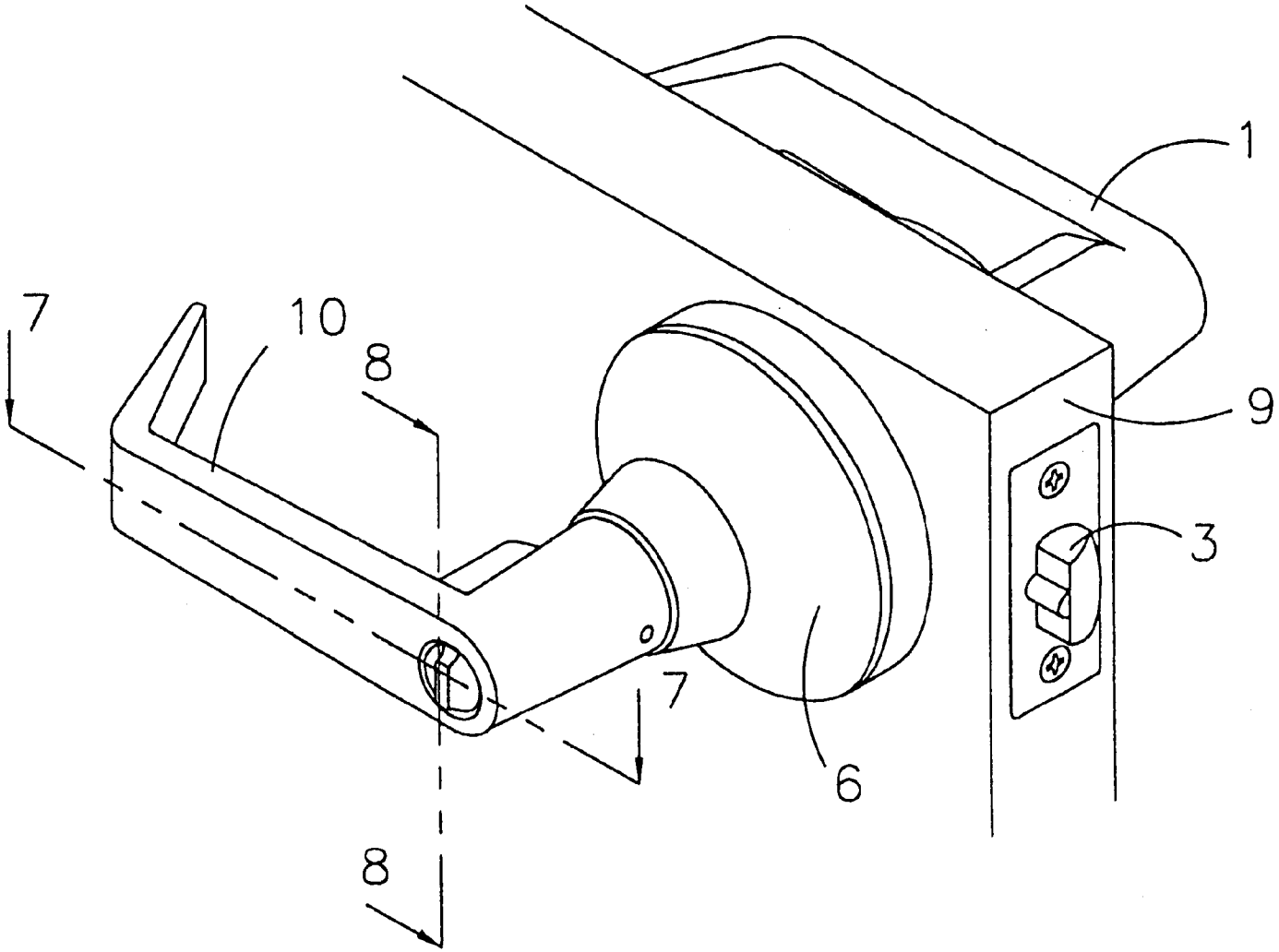
FIG. 6 is a perspective view showing the preferred embodiment of this invention after assembly.
Figure 7:
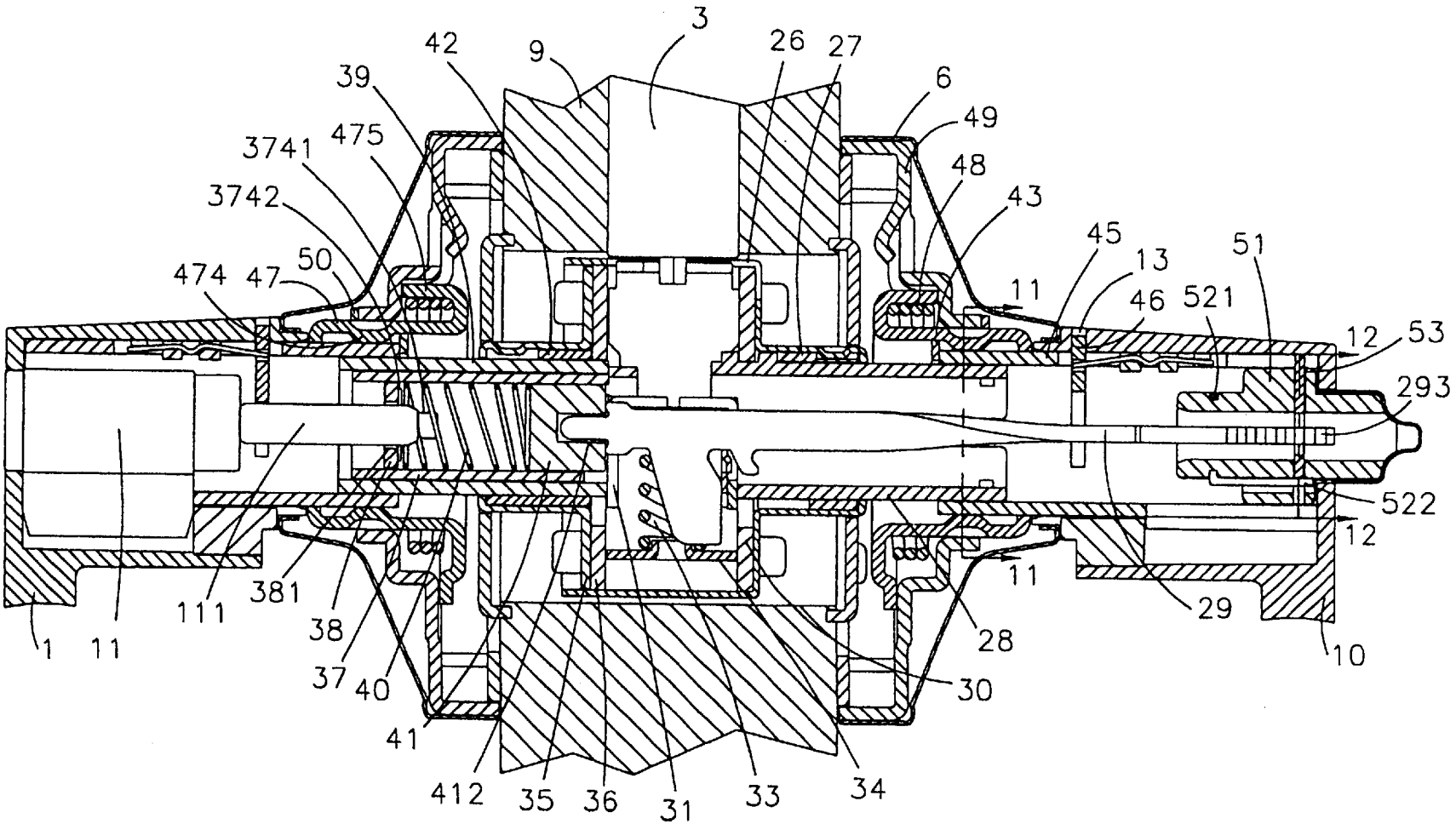
FIG. 7 is a cross sectional view showing the preferred embodiment of this invention taken along line 7—7 of FIG. 6, in which the present invention is mounted on a thicker door and the transmission element is at the first position.
Figure 9:
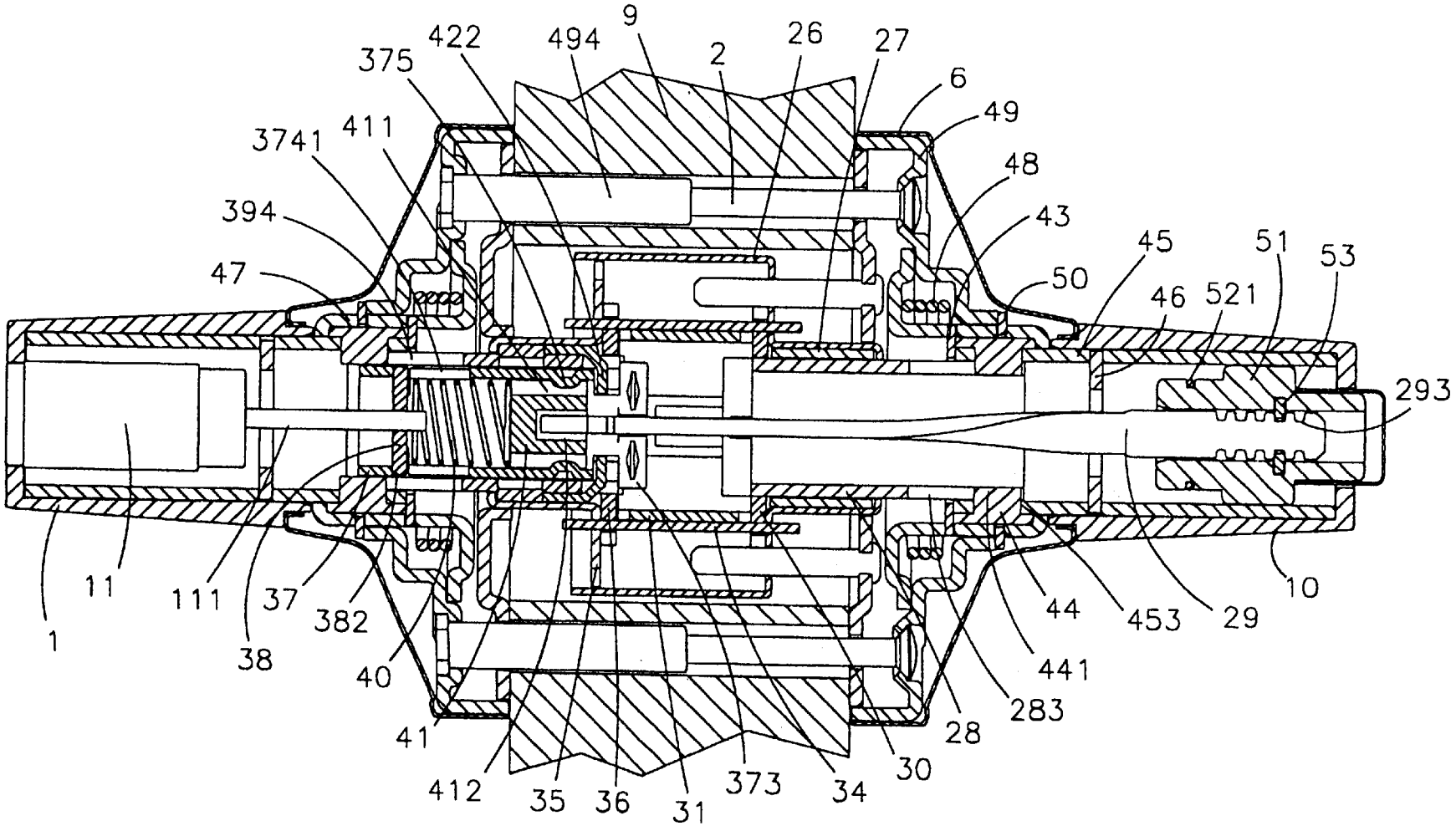
Figure 10:
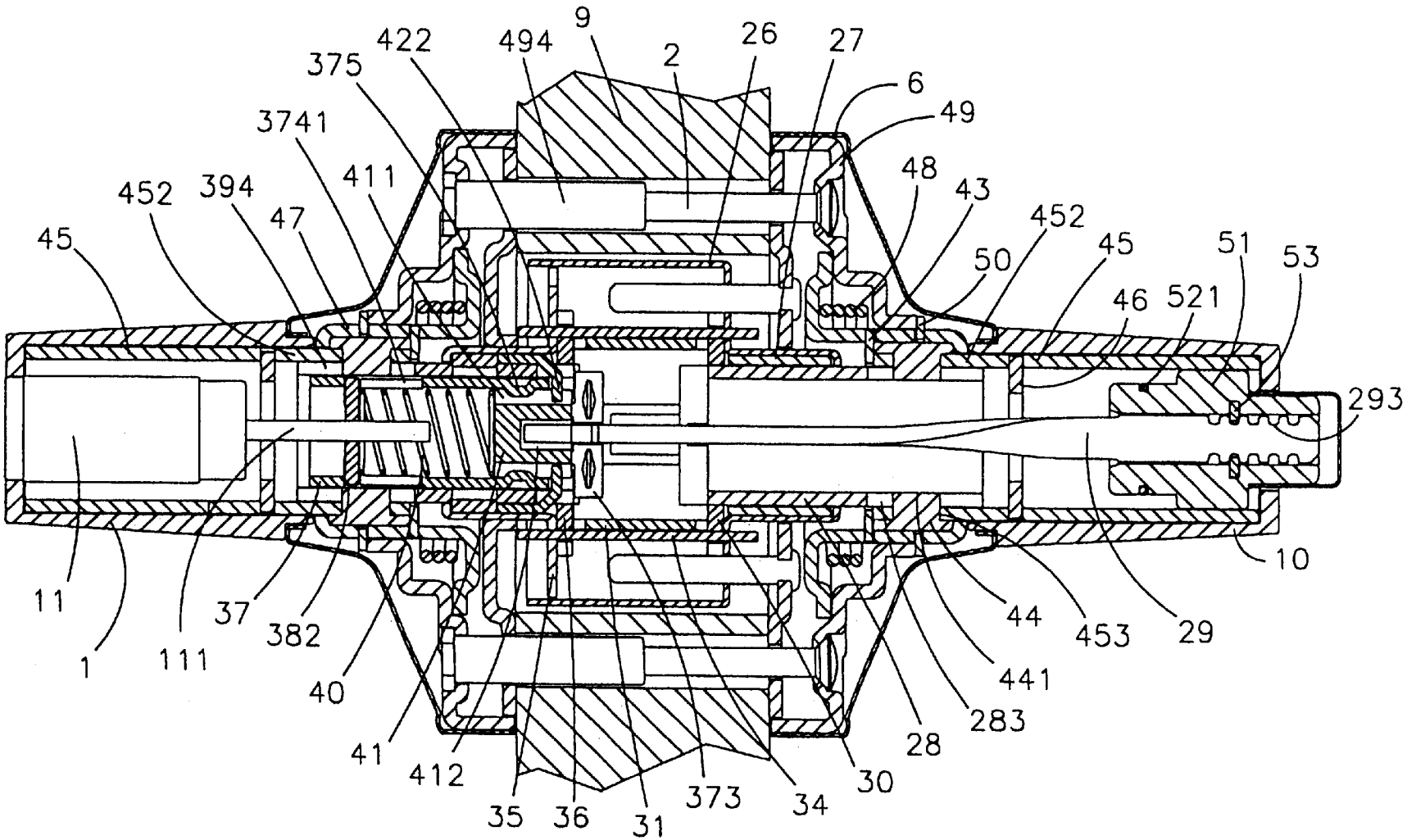
Figure 11:
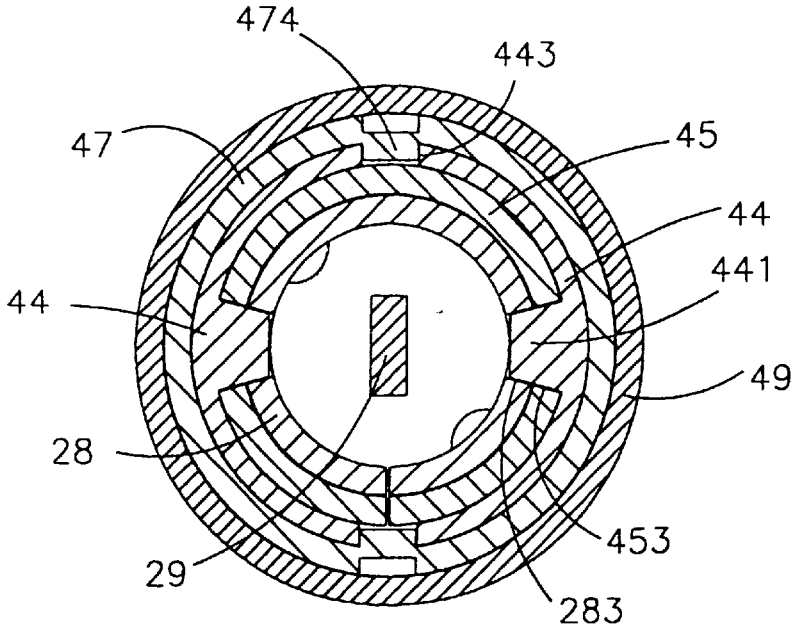
Figure 12:
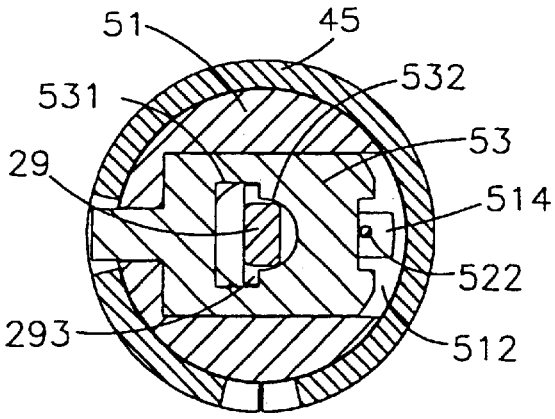
Figure 13:
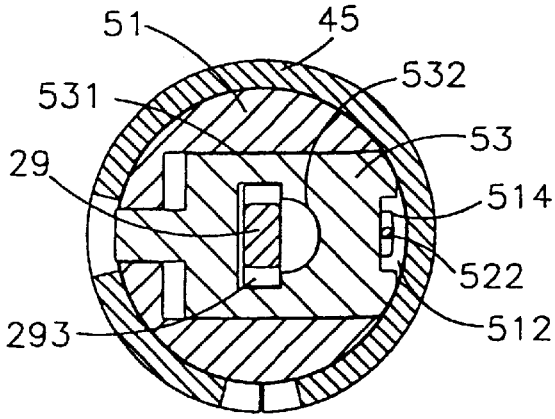

6, in which the present invention is mounted on a thicker door and the transmission element is at the first position;

FIG. 9 is a cross sectional view showing the preferred embodiment of this invention taken along line 8—8 of FIG. 6, in which the present invention is mounted on a thicker door and the transmission element is at the second position;

FIG. 10 is a cross sectional view showing the preferred embodiment of this invention taken along line 8—8 of FIG. 6, in which the present invention is mounted on a thinner door;

FIG. 11 is a cross sectional view showing the preferred embodiment of this invention take n along line 11—11 of FIG. 7;

FIG. 12 is a cross sectional view showing the preferred embodiment of this invention taken along line 12—12 of FIG. 7, in which the adjustment piece is not pressed down; and FIG. 13 is a cross sectional view showing the preferred embodiment of this invention taken along line 12—12 of FIG. 7, in which the adjustment piece is pressed down.

DETAILED DESCRIPTION OF THE INVENTION

Figure 1:
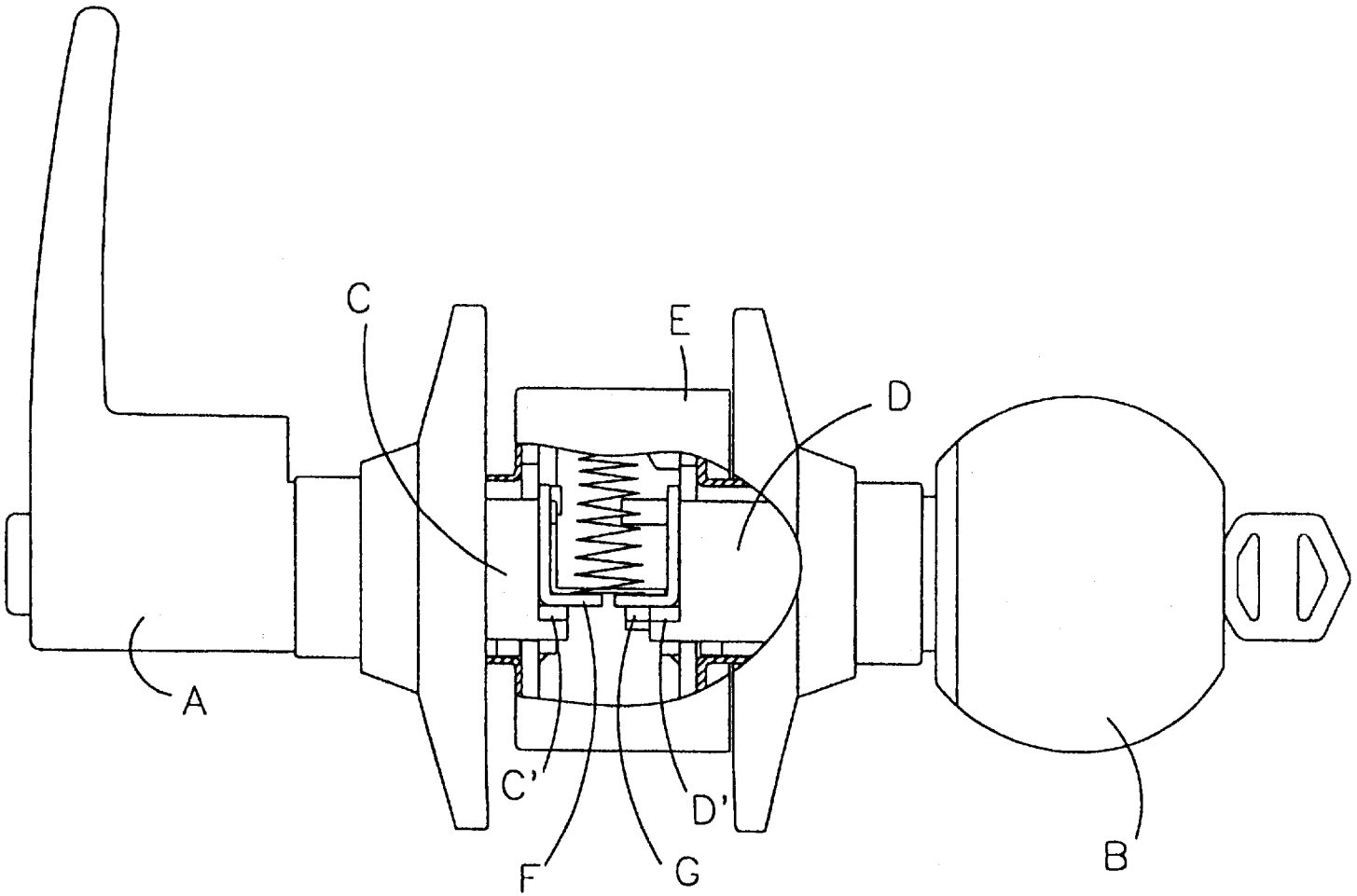
FIG.1 (PRIOR ART)
FIG. 1 is a partial cross sectional view of a conventional lock.
Figure 2:
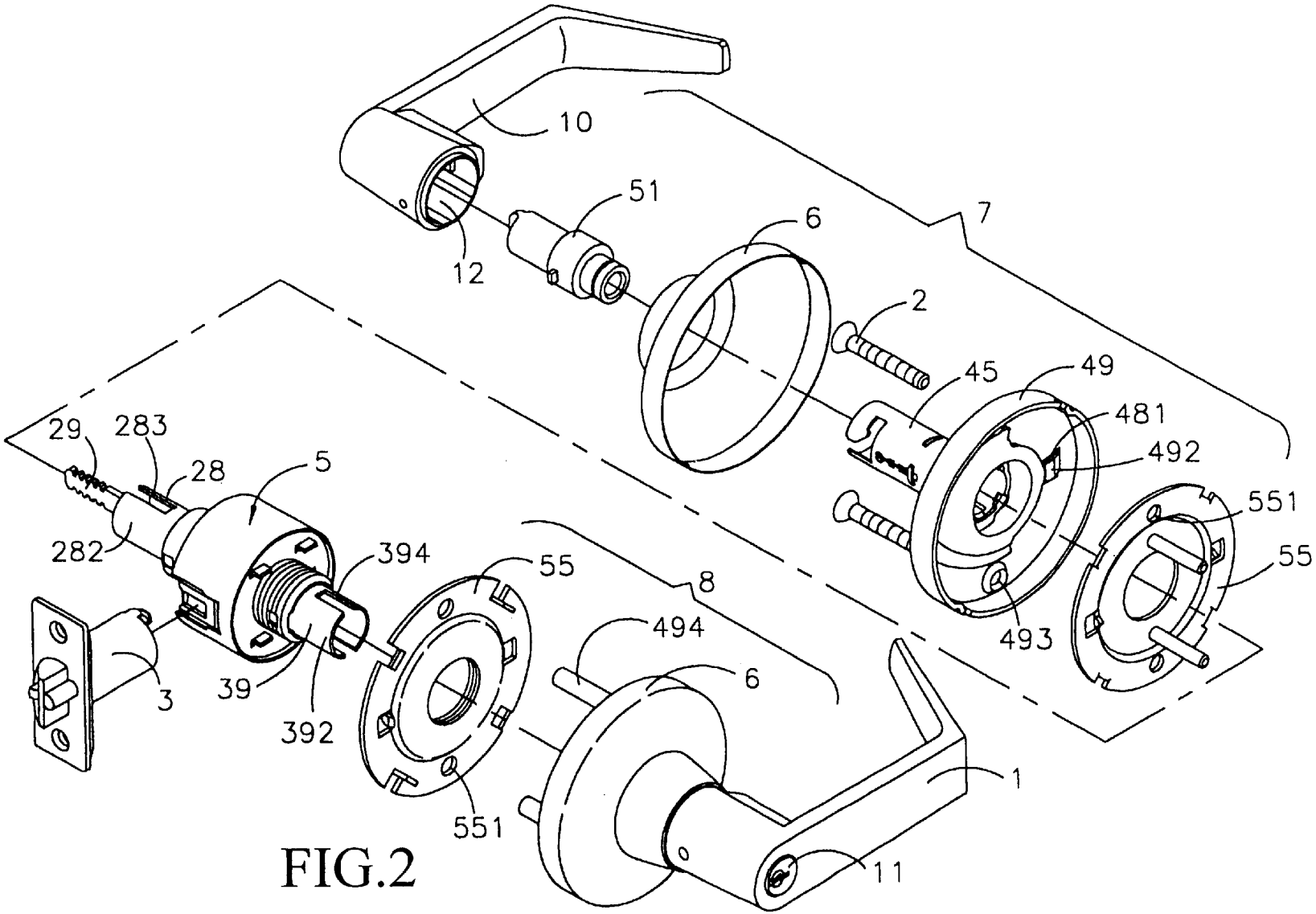
FIG. 2 is an exploded perspective view showing the preferred embodiment of this invention.
Figure 3:
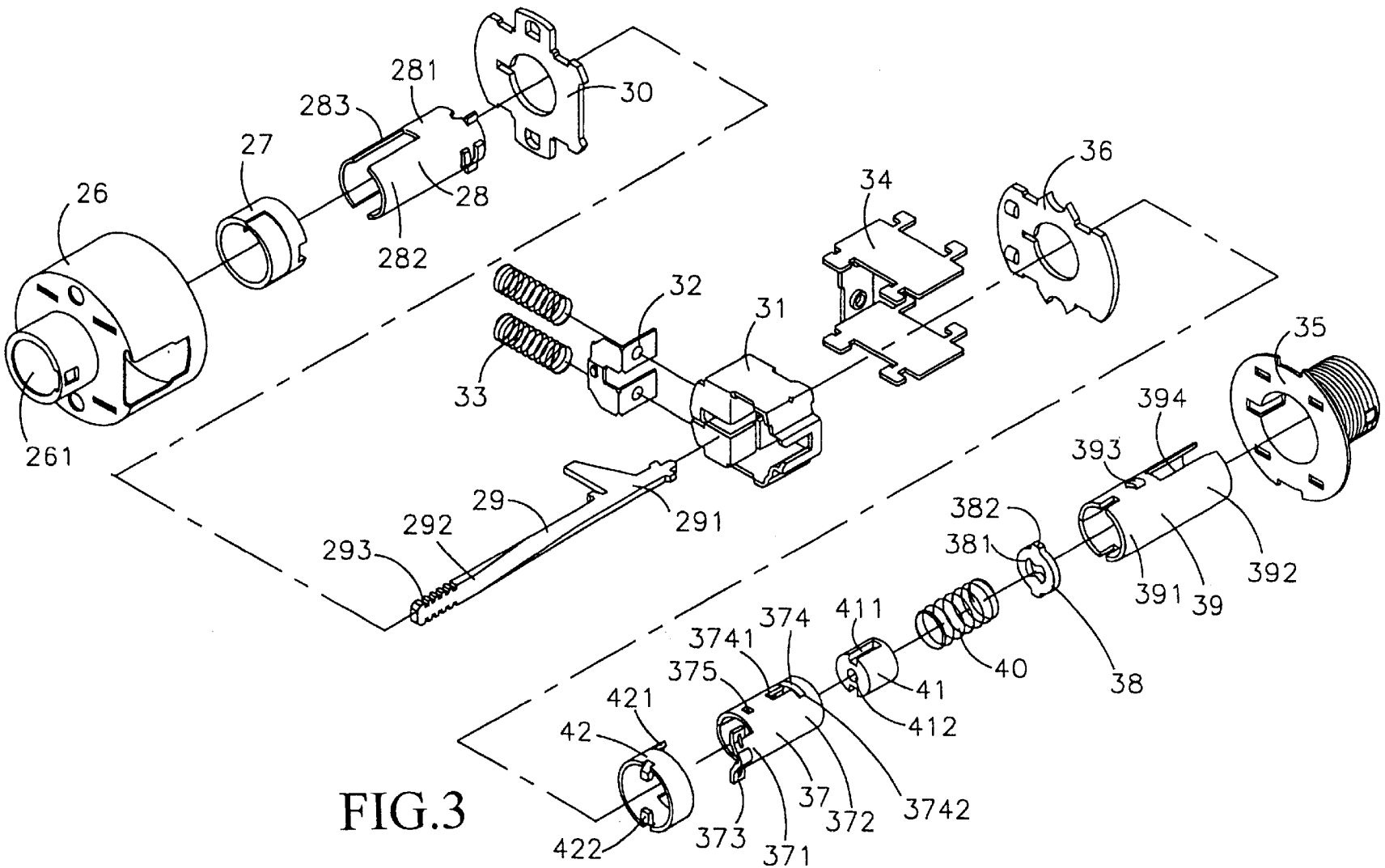
FIG. 3 is an exploded perspective view showing the locking mechanism of the preferred embodiment of this invention.

The preferred embodiments of this invention are described in detail as follows in association with the drawings. FIG. 2 shows one of the preferred embodiments of the lock of this invention, comprising a locking mechanism 5 for actuating a latch 3, and a sleeve disk assembly for mounting the locking mechanism 5 on a door. As illustrated in FIG. 3, the locking mechanism 5 comprises a housing assembly, a trigger 31, an inside actuation tube 28, an outside actuation tube 39, a key actuation tube 37, an actuation plate 38, a transmission element 41, a spring 40, an outside holding sleeve 42 and a knob rod 29. The housing assembly is formed by a cylindrical casing 26, an inside triggering plate 30, a triggering sleeve 34, an outside triggering plate 36 and an outside sleeve 35. The trigger 31, for actuating the latch 3, is mounted within the housing assembly and is provided with restoration force from triggering springs 33. A resilient triggering plate 32 is compressed by one end of the triggering springs 33 such that the knob rod 29 is locked by the resilient triggering plate 32 when the knob rod 29 is pressed down.

Figure 8:
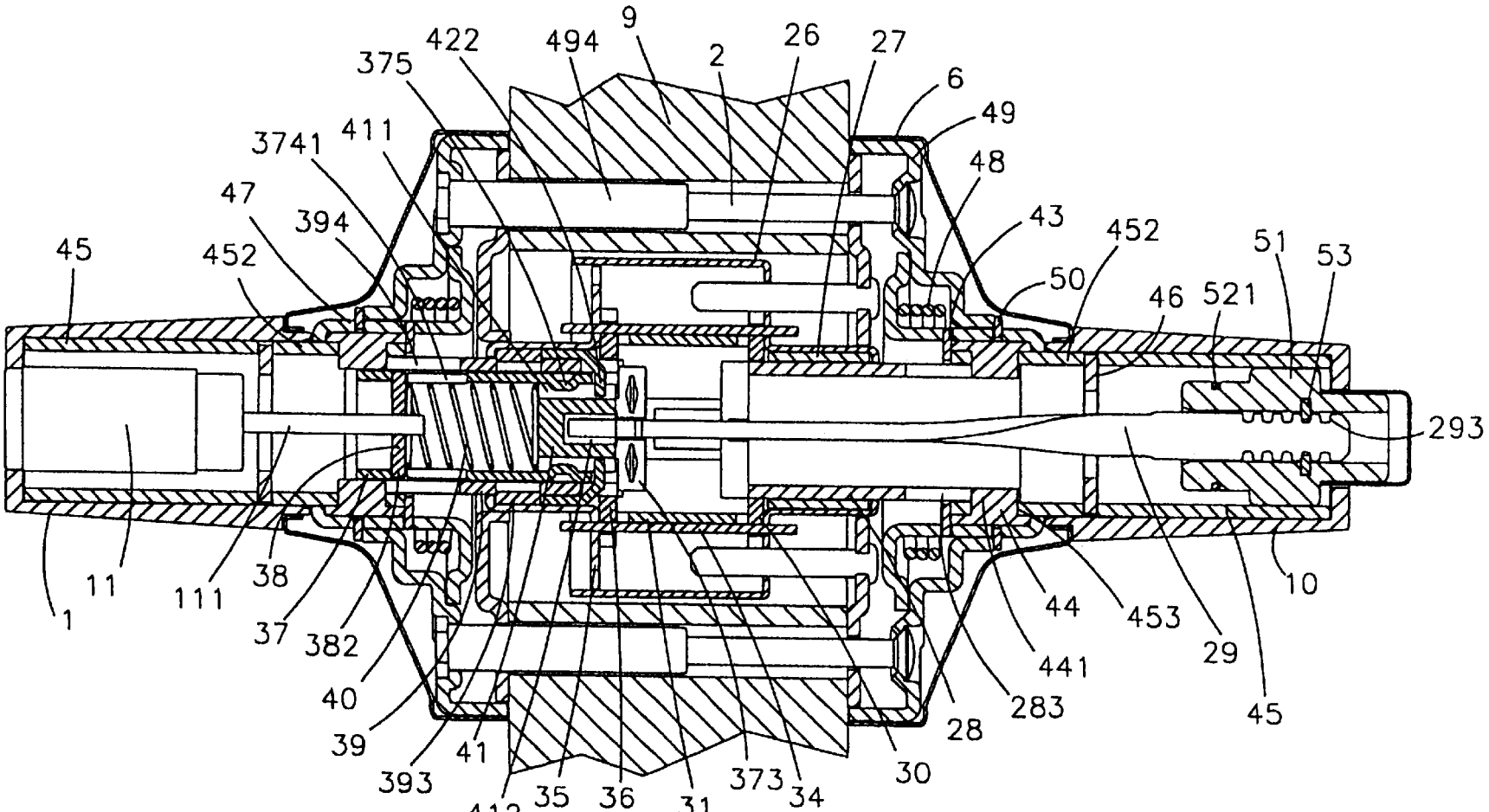
FIG. 8 is a cross sectional view showing the preferred embodiment of this invention taken along line 8—8 of FIG.

The inside actuation tube 28 is a hollow tube having a first end 281 and a second end 282. The first end 281 may actuate the trigger 31. The first end 281 is inserted into an inside holding sleeve 27 such that the inside actuation tube 28 can be stably rotated within a hole 261 of the cylindrical casing 26. The outside actuation tube 39 is also a hollow tube having a first end 391 and a second end 392. The first end 391 is inserted into the outside sleeve 35. The outside actuation tube 39 has two radially spaced projections 393 (only one projection is shown in the figure) on the exterior wall of the tube. The key actuation tube 37 is a hollow tube with the outer diameter thereof slightly smaller than the inner diameter of the outside actuation tube 39 for insertion thereinto. The key actuation tube 37 has a first end 371 and a second end 372, wherein the first end 371 has a pair of laterally extended actuation flanges 373 for actuating the trigger 31 to actuate the latch 3 connected with the trigger 31 to open the door 9. The second end 372 of the key actuation tube 37 has two laterally opposing T-shaped grooves 374 and each of the T-shaped grooves 374 includes an axial groove 3741 and a transverse groove 3742. The actuation plate 38 having an 8-shaped hole 381 is mounted in the key actuation tube 37 and the actuation plate 38 has two radially extended projections 382 to be inserted into the transverse grooves 3742 of the T-shaped grooves 374. Accordingly, the actuation plate 38 may be rotated for a predetermined angle with respect to the key actuation tube 37 without triggering the same. The outside handle 1 is provided with a lock assembly 11 therein which has a locking rod 111 to be inserted into the 8-shaped hole 381 of the actuation plate 38. Thus, when the user rotates a key (not shown in the figures), the locking rod 111 is first rotated correspondingly for a predetermined angle without triggering the actuation plate 38, and then the actuation plate 38 is rotated by the locking rod 111. The actuation plate 38 is also allowed to rotate for a predetermined angle without triggering the key actuation tube 37, and finally, the key actuation tube 37 is rotated by the actuation plate 38. The key actuation tube 37 has two radially opposing projections 375 (only one projection is shown in the figures) extended from the inner wall toward the center of the tube 37. The transmission element 41 is placed in the key actuation tube 37 and has two radially opposing grooves 411 to be meshed with the projections 375 of the key actuation tube 37. The transmission element 41 is thus axially movable between a first position (as shown in FIG. 8) and a second position (as shown in FIG. 9) and is rotated together with the key actuation tube 37. The transmission element 41 has an axial hole 412 at the center thereof. One end of the spring 40 resists against the transmission element 41 and the other end of the spring 40 resists against the actuation plate 38. The outside holding sleeve 42 is substantially a hollow tube with the inner diameter slightly larger than the outer diameter of the outside actuation tube 39. The outside holding sleeve 42 has two resisting areas 421 (only one shown in the figures) for resisting against the projections 393 of the outside actuation tube 39 such that the outside holding sleeve 42 is mounted on the first end 391 of the outside actuation tube 39 and is rotatable together with the outside actuation tube 39. In this preferred embodiment, the outside holding sleeve 42 further comprises two radially opposing projections 422 inwardly extending to the center of the sleeve so that the projections 422 can be selectively engaged with the grooves 411 of the transmission element 41. It should be noted that the number and position of the projections 422 of the outside holding sleeve 42 may be designed in different ways. For example, it is possible that only one projection 422 (not shown in the figures) is provided on the lateral side of the outside holding sleeve 42 while the same function and object of this invention can still be achieved. Of course, the number and position of the grooves 411 should be designed correspondingly. The first end 291 of the knob rod 29 is inserted into the axial hole 412 of the transmission element 41. Accordingly, when the knob rod 29 is pushed by an external force, it will push the transmission element 41 from the first axial position to the second axial position.

As shown in FIGS. 7 and 8, when the transmission element 41 is at the first position within the key actuation tube 37, the grooves 411 of the transmission element 41 are engaged with the projections 422 of the outside holding sleeve 42. Thus, if the outside handle 1 is rotated upon an external force to rotate the outside actuation tube 39, the outside holding sleeve 42, the transmission element 41 and the key actuation tube 37 will be subsequently rotated together. As a result, the actuation flange 373 of the key actuation tube 37 controls the trigger 31 to actuate the latch 3 for opening the door. When the knob rod 29 is pressed down such that the transmission element 41 is at the second axial position within the key actuation tube 37, the grooves 411 of the transmission element 41 are not engaged with the projections 422 of the outside holding sleeve 42. Thus, if the outside handle 1 is rotated upon an external force to rotate the outside actuation tube 39, the key actuation tube 37 will not be rotated since it is not engaged with the outside actuation tube 39. Therefore, the trigger 31 will not be activated for actuating the latch 3 and the door cannot be opened.

Figure 4:
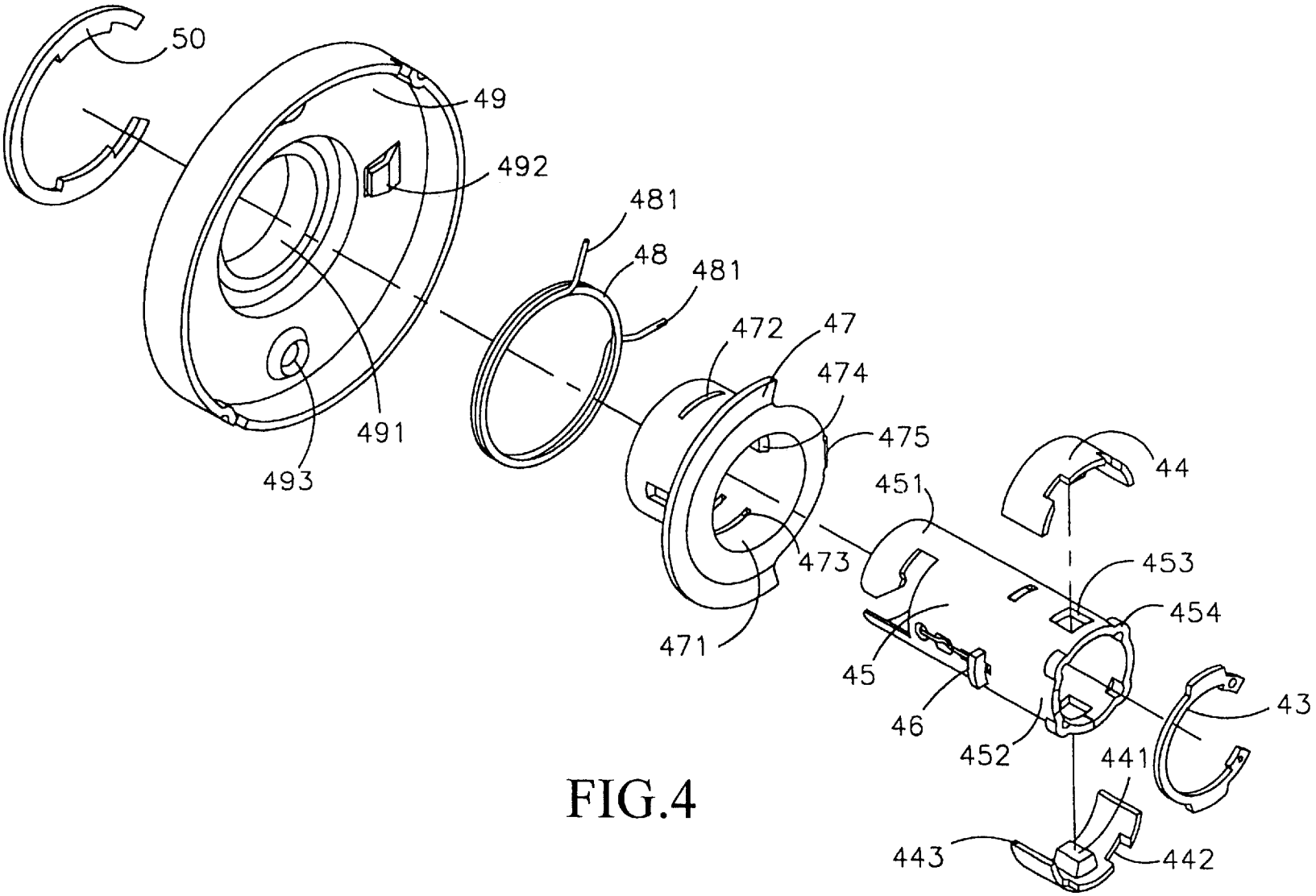
FIG. 4 is an exploded perspective view showing the sleeve disk assembly of the preferred embodiment of this invention.

As illustrated in FIGS. 2 and 4, the locking mechanism 5 is mounted on the door 9 by the sleeve disk assembly which includes an inside sleeve disk assembly 7 and an outside sleeve disk assembly 8 at each of the two sides of the door 9. Each of the inside and outside sleeve disk assemblies 7 and 8 has a rotative spring seat 47, a handle actuation tube 45, a fixing block 44, a sleeve disk 49, a reinforced sleeve disk 55 and a sleeve disk cover 6. Each of the inside and outside sleeve disk assemblies 7 and 8 further comprises an inside handle 10 and an outside handle 1. The rotative spring seat 47 is substantially a hollow cylinder with a hole 471 extending through the center thereof and a first guard ring slot 472 and a second guard ring slot 473 axially spaced on the circumferential wall of the hollow cylinder. The rotative spring seat 47 further has two radially opposing engagement parts 474 radially and inwardly extending from the circumferential wall.

A rotative ring spring 48 is mounted on the exterior surface of the rotative spring seat 47 and is installed in a hole 491 of the sleeve disk 49. The rotative ring spring 48 is further fixed into the first guard ring 472 of the rotative spring seat 47 by a first guard ring 50 and thus, the rotative spring seat 47 is rotatably and axially positioned on the sleeve disk 49. The rotative ring spring 48 has two legs 481 which adjacently resist against the two sides of a projection 492 on the sleeve disk 49. Therefore, when the rotative spring seat 47 is rotated, the protruding leg 475 on the rotative spring seat 47 triggers one of the legs 481 of the rotative ring spring 48. Because the other leg 481 still resists against the projection 492 of the sleeve disk 49, a restoration force is thereby produced for turning the rotative spring seat 47 back to its original position prior to rotation.

The handle actuation tube 45 of the inside and outside sleeve disk assemblies 7 and 8 is a hollow tube having a first end 451 passing through the hole 471 of the rotative spring seat 47 and is inserted into a hole 12 of the inside handle 10 and the outside handle 1. Each of the handle actuation tube 45 has a handle engagement plate 46 for meshing with the handle engagement holes 13 of the inside handle 10 and the outside handle 1. Thus, the handle actuation tubes 45 can be rotated together with the inside handle 10 and the outside handle 1. The handle actuation tube 45 has a second end 452 with two radially opposing holes 453 and four radially spaced projections 454. The second ends 452 of the handle actuation tube 45 of the inside and outside sleeve disk assemblies 7 and 8 are respectively connected with the second end 282 of the inside actuation tube 28 and the second end 392 of the outside actuation tube 39.

The two fixing blocks 44 are generally arcuate and have projections 441 radially extending from the inner wall of the fixing blocks 44. The fixing blocks 44 are positioned in the hole 471 of the rotative spring seat 47. The projections 441 pass through the holes 453 of the handle actuation tube 45 and engage with the grooves 283, at the second end 282 of the inside actuation tube 28, and the grooves 394, at the second end 392 of the outside actuation tube 39, as illustrated in FIGS. 8, 10 and 11. Thus, the rotation of the inside handle 10 (or the outside handle 1) rotates the handle actuation tube 45, the fixing block 44, and the inside actuation tube 28 (or the outside actuation tube 39) together. The fixing block 44 has notches 442 to be meshed with the projections 454 of the handle actuation tube 45 so as to increase the torsion strength between the fixing block 44 and the handle actuation tube 45. A second guard ring 43 is positioned adjacent to the second end 452 of the handle actuation tube 45 and is fixed into the second guard ring slot 473 of the rotative spring seat 47. Accordingly, the second end 452 of the handle actuation tube 45 is axially positioned in the hole 471 of the rotative spring seat 47. The fixing block 44 has engagement parts 443, which are the resisting surfaces formed at the arcuate edges of the fixing block 44 in the present embodiment. The engagement parts 443 respectively engage with and resist against the two engagement parts 474 of the rotative spring seat 47. Therefore, when the handle actuation tube 45 is rotated, the fixing blocks 44 and the rotative spring seat 47 will also be rotated accordingly.

Figure 5:
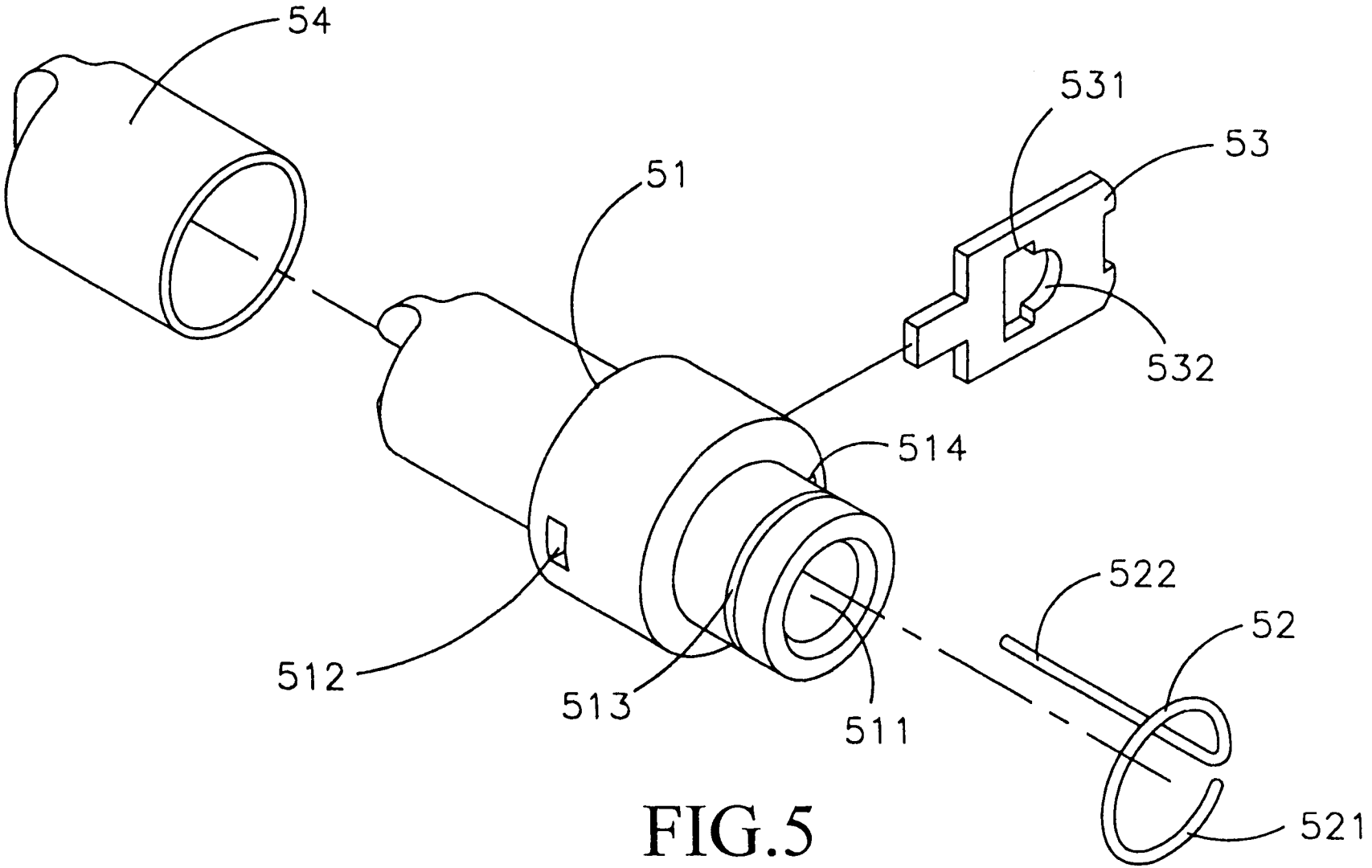
FIG. 5 is an exploded perspective view showing the push button of the preferred embodiment of this invention.

The knob rod 29 has a plurality of axially spaced grooves 293 at a second end 292 thereof. A push button 51, as shown in FIG. 5, has an axial hole 511 for receiving the knob rod 29 therethrough. The push button 51 comprises a transverse groove 512 for the insertion of a transversely movable adjustment piece 53. The adjustment piece 53 has a relatively large rectangular groove 531 and a relatively small semicircular groove 532 connected therewith. The knob rod 29 passes through the rectangular groove 531, while the semicircular groove 532 is selectively engaged with one of the several grooves 293 of the knob rod 29. A resilient element 52 has a ring portion 521 to be mounted on a mounting groove 513 of the push button 51, and an axial portion 522 to be inserted into a slot 514 of the push button 51. The axial portion 522 of the resilient element 52 is adjacent to the bottom of the adjustment piece 53 to provide the restoration force required for returning the adjustment piece 53 to its original position. A push button casing 54 is mounted on the push button 51 for easy compression thereon by the users. If the user wishes to adjust the axial position of the push button 51 with respect to the knob rod 29, as shown in FIGS. 12 and 13, the user first presses down the adjustment piece 53 which bias pushes the axial portion 522 of the resilient element 52, such that the semicircular groove 532 of the adjustment piece 53 becomes apart from the groove 293 of the knob rod 29. The push button 51 is then axially moved to a predetermined engagement position along the knob rod 29, the users then release the adjustment piece 53 so that the semicircular groove 532 of the adjustment piece 53 engages with the groove 293 of the knob rod 29, and thus, the adjustment of the axial position of the push button 51 is completed.

The assembling screws 2 are inserted into the holes 493 of the sleeve disk 49 of the inside sleeve disk assembly 7 at the inner side of the door and the threaded holes 551 of the reinforced sleeve disk 55, and are further screwed with the assembling posts 494 of the sleeve disk 49 of the outside sleeve disk assembly 8 at the outer side of the door and the sleeve disk cover 6, such that the complete locking mechanism 5 is mounted on the door 9, as shown in FIGS. 8 and 10. FIG. 8 shows that the present invention is mounted on a relatively thicker door, in which the second ends 452 of the handle actuation tubes 45 of the inside and outside sleeve disk assemblies 7 and 8 are inserted into the inside actuation tube 28 and the outside actuation tube 39 respectively at the axial positions further away from the door. On the other hand, FIG. 10 shows that the present invention is mounted on a relative thinner door, in which the second ends 452 of the handle actuation tubes 45 of the inside and outside sleeve disk assemblies 7 and 8 are inserted into the inside actuation tube 28 and the outside actuation tube 39 at the axial positions closer to the door. The semicircular groove 532 of the adjustment piece 53 of the push button 51 is engaged with the knob rod 29 at the groove 293 closer to the door. Therefore, the present invention is applicable to doors with a wide range of thicknesses.

This invention is related to a novel creation that makes a breakthrough to conventional art. Aforementioned explanations, however, are directed to the description of preferred embodiments according to this invention. Various changes and implementations can be made by persons skilled in the art without departing from the technical concept of this invention. Since this invention is not limited to the specific details described in connection with the preferred embodiments, changes to certain features of the preferred embodiments without altering the overall basic function of the invention are contemplated within the scope of the appended claims.

What is claimed is:

1. A lock, comprising a locking mechanism for actuating a latch and a sleeve disk assembly for mounting the locking mechanism on a door, wherein the locking mechanism comprises:

a housing assembly;

an outside actuation tube having a first end and a second end, of which the first end being mounted in the housing assembly;

a key actuation tube being inserted into the outside actuation tube and having a first end and a second end, of which the first end has an actuation flange, and the second end has an actuation plate, the key actuation tube also has at least one projection extending inwardly;

a transmission element provided in the key actuation tube and has at least one groove to be meshed with the at least one projection of the key actuation tube, thereby the transmission element is movable between a first axial position and a second axial position in the key actuation tube and is rotated together with the key actuation tube;

a spring with one end thereof resisting against the transmission element and the other end thereof resisting against the actuation plate;

an outside holding sleeve connected with the first end of the outside actuation tube so as to be rotated together with the outside actuation tube, the outside holding sleeve further having at least one projection extending inwardly;

a knob rod having a first end and a second end, of which the first end is connected with the transmission element and the second end is connected with a push button;

when the transmission element is at the first axial position within the key actuation tube, the at least one groove of the transmission element is engaged with the at least one projection of the outside holding sleeve, such that when the outside actuation tube is rotated, the outside holding sleeve and the key actuation tube is subsequently rotated therewith; when the transmission element is at the second axial position within the key actuation tube, the at least one groove of the transmission element is not engaged with the at least one projection of the outside holding sleeve, such that when the outside actuation tube is rotated, the key actuation tube is not rotated therewith.

2. The lock according to claim 1, wherein the outside actuation tube has at least one projection and the outside holding sleeve has at least one resisting area for resisting against the at least one projection of the outside actuation tube.

3. The lock according to claim 1, wherein the second end of the outside actuation tube has at least one groove; the sleeve disk assembly has a rotative spring seat, a handle actuation tube, at least one fixing block, and a handle for being held and rotated; the rotative spring seat has at least one engagement part; one end of the handle actuation tube is engaged with the handle, the other end of the handle actuation tube has a hole; the at least one fixing block has an engagement part engaging with the at least one engagement part of the rotative spring seat and has a projection passing through the hole of the handle actuation tube and engaging with the at least one groove of the outside actuation tube.

4. The lock according to claim 3, wherein the knob rod has a plurality of axially spaced grooves; and the push button comprises an adjustment piece which is selectively engaged with one of the grooves of the knob rod.

5. The lock according to claim 4, wherein the adjustment piece of the push button has a large groove and a small groove connected therewith.

6. The lock according to claim 3, wherein the at least one engagement part of the rotative spring seat is a projection, while the engagement part of the at least one fixing block is a resisting surface.

7. The lock according to claim 3, wherein the handle actuation tube has at least one projection and the at least one fixing block has at least one notch to be meshed with the at least one projection of the handle actuation tube.

8. A lock, comprising a locking mechanism for actuating a latch and a sleeve disk assembly for mounting the locking mechanism on a door, wherein the locking mechanism comprises:

a housing assembly;

an outside actuation tube having a first end and a second end of which the first end is mounted in the housing assembly, and the second end has at least one groove;

a key actuation tube being inserted into the outside actuation tube and having a first end and a second end of which the first end has an actuation flange, and the second end has an actuation plate, the key actuation tube also has at least one projection extending inwardly;

a transmission element provided in the key actuation tube and having at least one groove to be meshed with the at least one projection of the key actuation tube, thereby the transmission element is movable between a first axial position and a second axial position in the key actuation tube and is rotated together with the key actuation tube;

a spring with one end thereof resisting against the transmission element and the other end thereof resisting against the actuation plate;

an outside holding sleeve connected with the first end of the outside actuation tube so as to be rotated together with the outside actuation tube, the outside holding sleeve further has at least one projection extending inwardly;

a knob rod having a first end and a second end, in which the first end of the knob rod is connected with the transmission element and the second end of the knob rod is connected with a push button;

the sleeve disk assembly having a rotative spring seat, a handle actuation tube, at least one fixing block, and a handle for being held and rotated; the rotative spring seat has at least one engagement part; one end of the handle actuation tube is engaged with the handle, the other end of the handle actuation tube has a hole; the at least one fixing block has an engagement part engaging with the at least one engagement part of the rotative spring seat and has a projection passing through the hole of the handle actuation tube and engaging with the at least one groove of the outside actuation tube;

when the transmission element is at the first axial position within the key actuation tube, the at least one groove of the transmission element is engaged with the at least one projection of the outside holding sleeve, such that when the outside actuation tube is rotated, the outside holding sleeve and the key actuation tube is subsequently rotated therewith; when the transmission element is at the second axial position within the key actuation tube, the at least one groove of the transmission element is not engaged with the at least one projection of the outside holding sleeve, such that when the outside actuation tube is rotated, the key actuation tube is not rotated therewith.

* * * * *

UNITED STATES PATENT AND TRADEMARK OFFICE

CERTIFICATE OF CORRECTION

PATENT NO. : 6,575,006 B1
APPLICATION NO. : 10/136539
DATED : June 10, 2003
INVENTOR(S) : Lan-Kun Don It is certified that error appears in the above-identified patent and that said Letters Patent is hereby corrected as shown below:

CORRECT THE TITLE PAGE (73) TO READ:
(73) Assignee: Tong Lung Metal Industry Co., Ltd.

Signed and Sealed this

Twenty-eighth Day of November, 2006

JON W. DUDAS
*Director of the United States Patent and Trademark Office*